United States Patent [19]

Zhigalov et al.

[11] Patent Number: 4,694,642

[45] Date of Patent: Sep. 22, 1987

[54] METHOD AND APPARATUS FOR PRODUCING REINFORCED THREAD

[75] Inventors: Gennady V. Zhigalov; Abdurakhim Abduganiev; Sergei Y. Kim; Robert R. Mosheev, all of Tashkent, U.S.S.R.

[73] Assignee: Tashkentskoe Spetsialnoe Konstruktorskoe Bjuro Textilnykh Mashin, Tashkent, U.S.S.R.

[21] Appl. No.: 940,809

[22] Filed: Dec. 12, 1986

[51] Int. Cl.[4] ..... D01H 7/882; D02G 3/36

[52] U.S. Cl. ..... 57/5; 57/400; 57/404; 57/417

[58] Field of Search ..... 57/5, 6, 400, 404, 408, 57/414, 417

[56] References Cited

U.S. PATENT DOCUMENTS

| | | | |
|---|---|---|---|
| 3,411,283 | 11/1968 | Isomura | 57/414 |
| 3,501,905 | 3/1970 | Landwehrkamp et al. | 57/417 X |
| 3,605,395 | 9/1971 | Morikawa et al. | 57/5 X |
| 3,877,211 | 4/1975 | Saveliev et al. | 57/404 |
| 4,083,173 | 4/1978 | Artzt et al. | 57/5 |
| 4,285,192 | 8/1981 | Saveliev et al. | 57/400 |
| 4,364,223 | 12/1982 | Vignon | 57/5 |
| 4,527,384 | 7/1985 | Stejskal et al. | 57/404 |
| 4,628,678 | 12/1986 | Tikhonov et al. | 57/400 |

*Primary Examiner*—John Petrakes

*Attorney, Agent, or Firm*—Fleit, Jacobson, Cohn & Price

[57] ABSTRACT

The method of producing reinforced thread includes feeding loose fibres onto the disc of a rotary twisting member, guiding the core thread through the disc eccentrically with respect to the axis of rotation of the twisting member and conducting the winding of the fibres about the core thread, to form the reinforced thread by rotating the twisting member. The apparatus for performing the method of producing reinforced thread comprises fibre-separating means communicating with a twisting member having a flat disc with an axial bore and an opening for the passage of the core thread, arranged eccentrically with respect to the axis of rotation of the twisting member, a holder for a bobbin with the core thread, a unit for winding the reinforced thread, and a guide for the core thread having its geometric center overlying the plane of the disc and aligned with the axis of rotation of the twisting member.

2 Claims, 3 Drawing Figures

METHOD AND APPARATUS FOR PRODUCING REINFORCED THREAD

FIELD OF INVENTION

The invention relates to the spinning technology in the textile industry, and more particularly it relates to apparatus for producing reinforced thread or yarn.

The invention can be employed by enterprises of the textile industry.

A reinforced thread or yarn is a thread or filament having either loose fibres or filaments wound or twisted around its entire length, the thread or filament around which the fibres are wound being called the core or main thread, and the fibres or filaments wound or twisted around the core thread being called the winding component.

It is generally known that reinforced threads or yarns have been lately finding a broadening field of applications, owing to their offering a number of essential advantages over single threads or yarns, owing to the feasibility of integrating in various combinations the properties of the materials of the core thread and of the winding components and thus obtaining, correspondingly, any required characteristics of the final product, such as strength and being water-repellent and crease-proof.

BACKGROUND OF THE INVENTION

There are known at present various techniques of producing reinforced threads where fibres are used as the winding component. Among such techniques are various methods of open-end spinning wherein the wind-around fibres are obtained by breaking-up a fibrous lap or sliver in a fibre-separating device, and the fibres are wound or twisted around the core thread with the use of a twisting member generally employed in ringless spinning for yarn production in the form of either a spinning cup also called a spinning cell, or a disc mounted in the T-fashion on its axis of rotation, or else in other known forms, e.g. a funnel (cf. U.S. Pat. No. 3,605,395 dated 1971); since in a twisting member of any type the core thread to be wound around with fibres has to be guided through the axis of rotation of the twisting member, this axis or axle is made hollow.

Thus, the production of reinforced thread or yarn can make use of any techniques and devices for ringless open-end spinning employing the so-called once-through spinning principle according to which loose fibres are fed to the twisting member from one end thereof, and the final yarn is withdrawn from its other end through the hollow axle (cf. U.S. Pat. Nos. 3,411,283 dated 1968, and 3,501,905, dated 1970).

However, the employment of various twisting members for producing reinforced thread or yarn, be they in the form of either a spinning cup or a disc, gives rise to various specific problems needing solution. Thus, when a spinning cup is employed, there arises the problem of the quality of the thread or yarn produced, as in this case the density of winding fibres around the core thread depends solely on the tension of these fibres, maintained exclusively by the centrifugal forces which, with the practically attained speeds of rotation of spinning cups, have proved to be insufficient for ensuring the required strength of the winding. Alternatively, when a twisting member in the form of a disc is used, this gives rise to a problem of fighting the scattering of fibres from the surface of the disc under the action of the centrifugal forces, which can be solved either by ensuring reliable retaining of the fibres on the surface of the disc prior to their engagement and entanglement by the core thread, or by ensuring the engagement and entanglement by the core thread of the maximum amount of the supplied fibres prior to the action of the centrifugal forces thereupon.

The herein disclosed method and the apparatus for performing same are specifically intended for solving the last-mentioned problem.

There is known a method of producing reinforced thread or yarn and apparatus for performing this method, in that the separated fibres are retained on the surface of the disc by mechanical means including projections provided on the surface of the disc and uniformly spaced along a circle spaced from the axis of rotation of the twisting members, and through-going radial slits made in the body of the disc for the passage of the air stream and likewise uniformly angularly spaced, with at least one projection accommodated intermediate any two adjacent slits.

The projections form on the surface of the disc a rim helping to collect and retain the main stream of the fibres at the central portion of the disc, which allows for performing the thread-reinforcing process at higher speeds. This has been made possible because when the speed of rotation of the twisting member is increased, and the growing centrifugal forces tend to propel the fibres off the surface of the disc, the mechanical action of the projections opposes such propelling. Moreover, the radial slits made through the disc not only support the passage through the disc of the air stream carrying loose fibres toward the surface of the disc, but also do not resist the free passsge through the disc of lint and impurities contained in the stream of fibres, which provides for prolonged performance of the twisting member without clogging that could necessitate its cleaning.

However, all the abovementioned techniques and means for retaining fibres on the surface of the disc in the known processes and apparatus have proved to be inadequately effective, since all of them are concerned with opposing the centrifugal forces acting upon the fibres on the surface of the disc while these fibres are in the loose state, and neither of them makes use of the opportunity of positively precluding the action of the centrifugal forces on the loose fibres by engaging and twisting-in these fibres by the core thread before they come into contact with the surface of the disc, i.e. before the centrifugal forces are able to act upon them. Therefore, the percentage of fibres lost from the surface of the disc remains in these processes and apparatus relatively high, amounting to 10–12% of the total amount fed to the disc in the case of lightweight natural fibres, or even to as high as 20% in the case of heavier synthetic fibres.

This problem has been partly solved in the known method of producing reinforced thread (cf. GB Pat. No. 8608553, 08/04/86) by ringless open-end spinning, including feeding a stream of loose fibres onto the flat surface of the disc of a rotating twisting member, guiding a core thread through this disc and winding the fibres around this core thread by rotation of the twisting member, whereby the reinforced thread is produced.

This method is characterized in that it includes feeding to the twisting member and guiding through the disc at least two core threads extending at an angle to one another. Thus, these threads form in their motion a "wedge" in the path of the loose fibres, engaging and catching these fibres. Owing to the axial motion of the core threads and their joining in the axial bore of the disc, the fibres eventually become pinched by the core threads and practically are not deposited into the surface of the disc, but are drawn by the core threads into the axial bore of the disc where the centrifugal forces are virtually non-existent, and where the fibres have their ends wound around the core threads. Thus, the loose fibres coming between the core threads are driven past the zone of action of the centrifugal forces, whereby the loss and waste of fibres is reduced, and the yield of satisfactory reinforced thread is stepped up, same as the output of the machines embodying this method.

The abovedescribed effect is significantly enhanced as the number of the core threads is increased, because the more core threads take part in the process, the greater number of the "wedges" or fibre-pinching areas is formed, and the more fibres are carried past the zone of action of the centrifugal forces.

There is also known an apparatus for performing the last-described method of producing reinforced thread (cf. GB Pat. No. 8608553, 08/04/86), comprising means of separating the fibres, a twisting member including a flat disc with an axial bore, communicating with the means for separating the fibres through a fibre-guiding duct and having means for retaining the fibres and radial slits for the passage of the stream of air produced by the blades radially secured on the body of the twisting member and on the surface of the flat disc, facing the body of the twisting member, a holder for a bobbin with the core thread, a unit for winding the reinforced thread, and a guide for the core thread, overlying the plane of the flat disc.

This apparatus is characterized in that it comprises, in addition to the main guide of the core thread in the form of an opening in the housing of the apparatus, offset relative to the axial bore in the disc, a plurality of additional guides for respective additional core threads, likewise in the form of openings in the housing of the apparatus, offset relative to the axial bore in the disc. These openings through the housing of the apparatus are so arranged with respect to one another that any two adjacent core threads guided by them toward the axial bore of the disc define therebetween an angle with the apex at the inlet of the axial bore, which provides for pinching the supplied loose fibres entering this angle between the two core threads in their motion, and thus precluding the action of the centrifugal forces upon these fibres.

It is easy to conclude from the above description of the process of interaction of the core threads with the fibres in the last-mentioned method that the smaller is the angle of the "wedge" formed by the core threads, the better are the conditions of pinching the fibres by these threads, since the latter, when the angle defined by them is small, come close together even before they are joined in the axial bore of the disc. This extends the zone of pinching the fibres by the core threads and enhances their engagement capacity, and also minimizes the possibility of the fibres falling out or being taken from the "wedge" by the motion of the core threads or by the stream of air.

However, when the angles defined by the core threads are small, the area which they span across the path of the stream of loose fibres, i.e. the area of eventual engagement and pinching of the fibres by these threads, is but a fraction of the total cross-sectional area of the stream of fibres, as the latter are uniformly supplied onto the entire fibre-collecting surface of the disc defined by the projections. Consequently, but a small part of the total volume of the supplied fibres can be engaged by the core threads, whereas the greater part is beyond the area of the "wedge" of the core threads and reaches the surface of the disc, to be acted thereon by the centrifugal forces.

Therefore, the effect of reducing the loss of fibres from the surface of the disc, attained by the last-described known method and apparatus, is quite moderate, and practically does not exceed 1–2% in case of natural fibres with rough surfaces, or even 0.5–1.5% in case of smooth synthetic fibres.

Furthermore, in order to perform this known method and to attain the effect it offers, it is necessary to have at least two core threads, which means that the method can be utilized, predominantly, for production of coarse and thick reinforced threads, i.e. of threads of low Nos or counts. Higher Nos or counts of reinforced thread (when either the technology or the requirements put before the final thread would not permit having more than one core thread) cannot be produced by the known method, which curbs the range of reinforced threads that can be manufactured with the employment of this method and by apparatus performing this method.

SUMMARY OF THE INVENTION

It is an object of the present invention to create a method of producing reinforced thread and an apparatus capable of performing this method, which should provide for reducing significantly the loss of fibre, decreasing the percentage of waste and broadening the range of reinforced threads produced by the method.

These and other objects are ataained in a method of producing reinforced thread in a ringless open-end spinning process, including feeding a stream of loose fibres onto the flat surface of the disc of a rotary twisting member, guiding a core thread through the disc of the twisting member and winding fibres around the core thread to form a reinforced thread, by rotating the twisting member, in which method, in accordance with the invention, the core thread is guided through the disc of the twisting member eccentrically with respect to the axis of rotation of this twisting member, to produce by rotation of the twisting member, two balloons of the core thread, disposed to the opposite sides of the disc, the respective apexes of the balloons being aligned with the axis of rotation of the twisting member.

The object of the invention is also attained in an apparatus for producing reinforced thread, comprising means for separating fibres, a twisting member including a flat disc with an axial bore communicating with the fibre-separating means through a fibre-guiding duct, the flat disc having means for retaining the fibres and radial slits for the passage of the stream of air produced by the blades radially secured on the body of the twisting member and on the surface of the flat disc, facing the body of the twisting member, a holder for a bobbin with the core thread, a unit for winding the reinforced thread, and a guide for the core thread, overlying the plane of the flat disc, in which apparatus, in accordance with the invention, the flat disc has made therein, eccentrically with respect to the axis of rotation of the twisting member, an opening for the passage of the core thread, the geometric centre of the guide for the core thread being aligned with the axis of rotation of the twisting member.

The invention enhances the efficiency of spinning-cum-reinforcing machines and their output, and allows for broadening the range of fabrics with various required properties.

SUMMARY OF THE DRAWINGS

The invention is further described in connection with an embodiment thereof, with reference being made to the accompanying drawings, wherein.

DETAILED DESCRIPTION OF THE INVENTION

Figure 1:
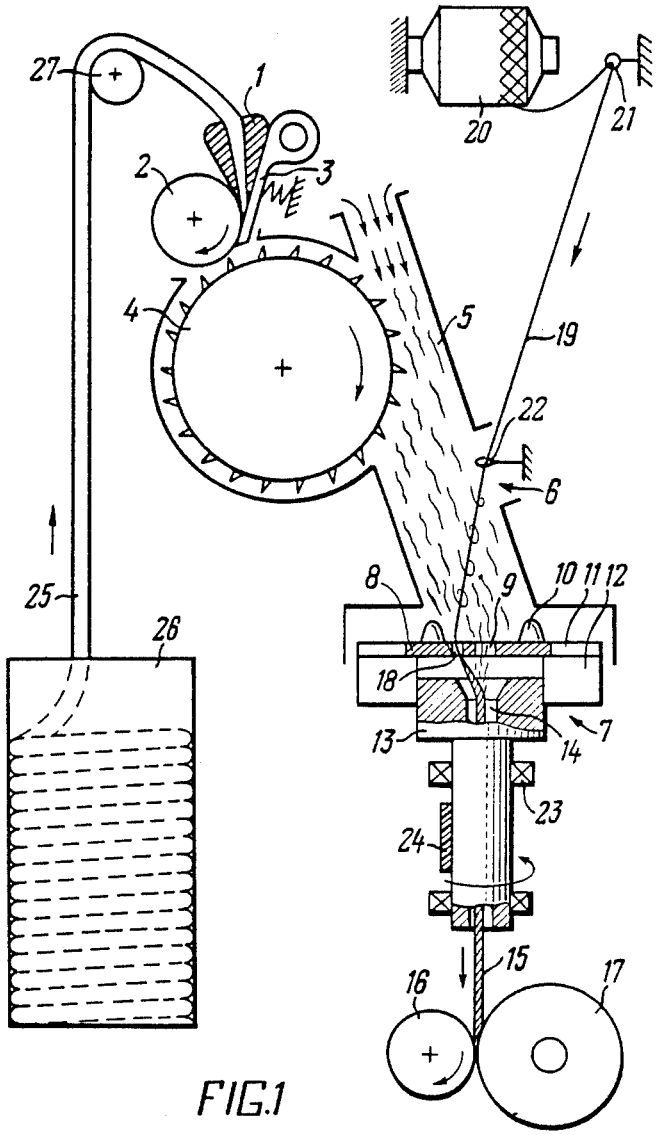
FIG. 1 schematically illustrates an apparatus for producing reinforced thread, embodying the invention.

The herein disclosed method is performed by the open-end spinning technique, as follows.

A fibrous strand or sliver is broken up in a fibre-separating means into individual loose fibres. The stream of loose fibres thus obtained is supplied onto the flat surface of the disc of a rotating twisting member. The core thread is unwound from the supplied bobbin and fed, first, through a guide of which the geometric centre is aligned with the axis of rotation of the twisting member, and then through an opening in the disc eccentric with respect to this axis of rotation, and then through the axial bore of the twisting member. The twisting member is rotated to wound the fibres about the core thread and thus to produce the reinforced thread.

The principle of ringless open-end spinning is embodied here, as follows. When the core thread is wound around by the fibres that are generally indexed radially from the axis of the disc on the surface of this disc, which is provided for by the presence of the radial slits in the disc, the ends of those fibres which are the closest to the core thread and in contact with it are the first to be engaged by the core thread and wrapped therearound. Then the free ends of these twisted-in fibres, sweeeping the surface of the disc owing to its rotation, engage other fibres more remote from the core thread, so that there is always present on the surface of the disc in operation the end of the "tail" of fibres already wrapped around the core thread and rotating about its axis (the so-called "open end"), which engages and then twists around the core thread the newer and newer portions of the loose fibres being supplied.

As the disc jointly with the core thread revolves about the axis of rotation of the twisting member, the core thread forms two balloons of which one, i.e. the top balloon, overlies the disc, and the other one, i.e. the bottom balloon, underlies it. The apexes of these two balloons are aligned with the axis of rotation of the twisting member, by having the guide of the core thread aligned with this axis of rotation (the top balloon), and by guiding the final reinforced thread through the axial bore of the twisting member and withdrawing it through this bore (the bottom balloon).

The effect of reducing the loss of fibres, attained by the method of the present invention, is due to the top balloon formed by the core thread intersecting at a high frequency the path of the stream of loose fibres moving toward the central portion of the disc. Thus, the core thread cuts into this stream of fibres at a high velocity and encounters in this stream numerous individual fibres, the encounter with an individual fibre being an impact which makes this fibre bend and whip about the core thread. Hence, a great number of the fibres is engaged by the core thread striking the fibres already in the air, at the approach to the surface of the disc. Owing to the known phenomenon of adhesion of fibres to one another, the fibres engaged by the core thread are joined by other fibres that have not been thus directly engaged, which fact increases the total amount of fibres taken by the core thread before they reach the disc. When the balloon of the core thread spans the entire cross-section of the stream of fibres, the core thread engages in the air and twists in the maximum amount of the fibres from the stream fed onto the entire receiving surface of the disc. As the height and diameter of the balloon of the core thread are adjustable at will by adjusting the height of the guide and selecting the degree of eccentricity of the opening in the disc for the passage of this thread, it is possible in this way to control the area of the cross-section of the moving stream of fibres, spanned by the balloon of the core thread, i.e. the zone of action of the balloon in the stream of fibres, and thus to optimize the extent of this zone in accordance with the type of the fibres being handled and the required properties of the reinforced thread being produced.

Those fibres which reach the surface of the disc and are moved along this surface by the centrifugal forces toward the periphery of the disc are likewise met on their way by the top balloon of the core thread, whipping and engaging them in a manner similar to its performance in the air, which reduces the loss of fibres still further.

Those fibres which are carried by the stream of air through the axial opening of the disc to its underside are encountered by the bottom balloon of the core thread, interacting with them similarly to the top balloon.

Thus, the separated loose fibres are repeatedly acted upon in their travel toward the rotating twisting member and within this member by the balloons of the core thread, engaging them and twisting or spinning them in, whereby the loss of fibres from the surface of the disc has been significantly reduced, practically to one fifth--one sixth of the otherwise attainable value, and does not exceed 2–3%.

For example, in the production of reinforced thread of 250 tex linear density of a core thread of lavsan (polyester fibre) of 111 tex linear density and short cotton wound-around fibres, at 30,000 rpm of the twisting member and 60 m/min thread delivery rate, the loss of fibres from the surface of the disc was within 2.5%.

The reinforced thread produced is guided to the winding unit and wound into a package.

The apparatus for producing reinforced thread comprises the fibre-separating means including a guiding and compacting funnel 1 (FIG. 1), a feed couple made of a feed roller 2 and an apron 3 spring-urged toward the roller 2, with the outlet of the funnel 1 being positioned at the nip of the feed couple, and a carding roller accommodated in the housing provided with a fibre-guiding duct 5, with an opening 6 made in the side wall of this duct 5.

The apparatus further comprises a twisting member 7 having a flat disc 8 with an axial bore 9, means for retaining the fibres, which in the presently described embodiment is on the form of cone-shaped projections 10, and radial slits 11 for the passage of the stream of air created by fan blades 12 radially arranged on the cylindrical body 13 of the twisting member and supporting the flat disc 8.

An axial bore 14 is made through the cylindrical body 13 for guiding the reinforced thread 15 toward the winding unit formed by a friction roller 16 and a package 17.

Made through the flat disc 8 eccentrically with respect to the axis of rotation is an opening 18 for the passage of the core thread 19 unwound from a bobbin 20 mounted on a holder, running through an eyelet 21 and a core thread guide 22 arranged in the opening 6 so that its geometric centre is aligned with the axis of rotation of the twisting member 7. The twisting member 7 is journalled for rotation in bearings 23 and is driven in operation of a driving belt 24.

The feed product is fibrous sliver 25 fed from a can 26 by a feed roller 27.

Figures 2, 3:
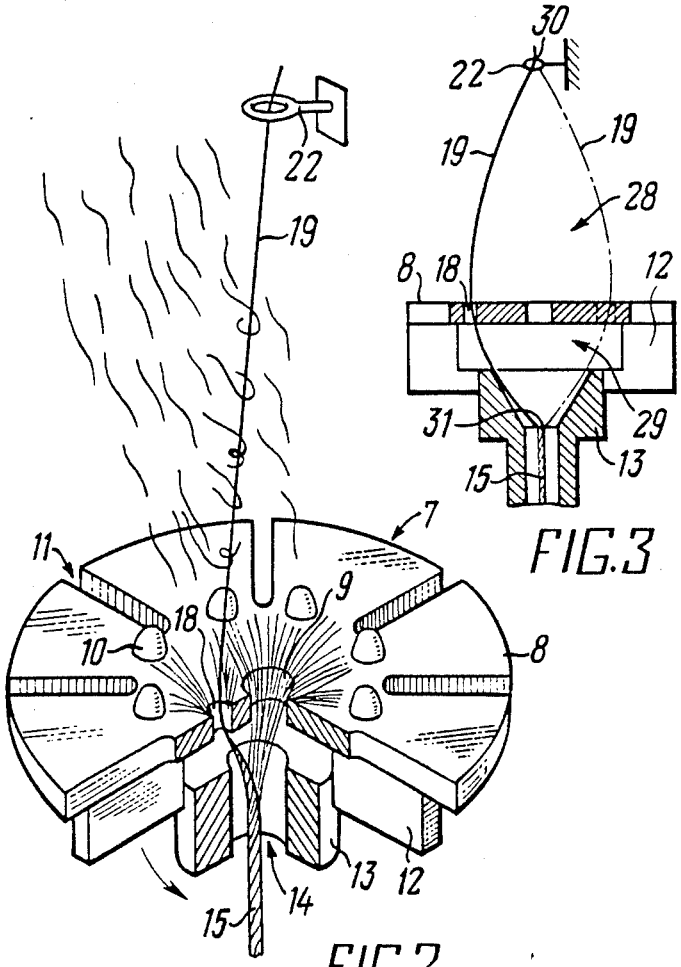
FIG. 2 is a partly sectional perspective view of the disc of the twisting member, in accordance with the invention.
FIG. 3 schematically illustrates the two balloons of the core thread, according to the invention.

FIG. 3 schematically illustrates in more detail the two balloons 28, 29 of the core thread, with their respective apexes 30 and 31.

The apparatus operates, as follows.

The fibrous sliver 25 (FIG. 1) is supplied from the can 26 by the roller 27 into the compacting funnel 1 where the sliver is compacted and levelled out. The compacted sliver rins from the compacting funnel into the nip of the feed couple 2,3 which directs it onto the carding roller 4. The roller 4 breaks up the sliver 25 into individual loose fibres which are taken off the teeth of the roller 4 by the stream of air that carries them down the fibre-guiding duct 5 to the twisting member 7. The stream of air for supplying loose fibres along the duct 5 is created by the fan blades 12 of the rotating twisting member 7. The loose fibres are supplied onto the surface of the flat disc 8 where they are generally indexed radially, owing to the division of the stream of air by the radial slits 11, and settle intermediate the cone-shaped projections 10 acting as the means retaining the fibres. The core thread 19 is unwound from the supply bobbin 20 and guided through the eyelet 21 and through the thread guide 22 whose geometric centre is aligned with the axis of rotation of the twisting member 7, into the opening 18 and then into the axial bore 14. As the twisting member 7 is rotated by the driving belt 24, the core thread 19 forms in the path of the fibres along the duct 5 two balloons: the top one with the apex in the orifice of the guide 22, and the bottom one with the apex in the axial bore 14. Encountering at a high velocity the fibres in the stream, the core thread 19 engages and twists them around it by whipping, as it is illustrated in FIG. 2. These engaged fibres are joined at the surface of the disc 8 by other fibres lying intermediate the projections 10 and partly in the radial slits 11, in which way is formed the reinforced thread 15 guided through the axial bore 14 to the winding unit where the friction roller 16 assists in winding it into the package 17.

The feasibility of using a single core thread of any linear density and of any kind of fibres for solving the above described problem and attaining the positive effect by the herein disclosed method opens way to producing a wide assortment of reinforced threads of both high and low Nos or counts, with low input of fibres.

Thus, the herein disclosed method of producing reinforced thread and the apparatus for performing this method provide for substantial reduction of the loss of fibres and percentage of waste, while broadening the range of reinforced threads that can be produced.

What is claimed is:

1. A method of producing reinforced thread by winding fibres around a core thread in a ringless open-end spinning process, using a twisting member, including:

supplying a stream of loose fibres onto the flat surface of the disc of a rotating twisting member, said twisting member having an axis of rotation;

guiding a core thread through said disc of said twisting member eccentrically with respect of said axis of rotation of said twisting member, to form by rotation of said twisting member two balloons of said core thread with their respective apexes disposed to the opposite sides of said disc;

aligning said respective apexes of said balloons with said axis of rotation of said twisting member;

rotating said twisting member to wind said fibres around said core thread, for forming the reinforced thread.

2. An apparatus for producing reinforced thread by winding fibres around a core thread in an open-end ringless spinning process, comprising:

a guide for the core thread;

fibre-separating means;

a twisting member having an axis of rotation; a body of said twisting member; and blades radially arranged on said body of said twisting member;

a fibre-guiding duct;

said twisting member communicating through said fibre-guiding duct with said fibre-separating means;

said guide for the core thread having a geometric centre, said centre being aligned with said axis of rotation;

a flat disc of said twisting member; an axial bore in said flat disc; means on said flat disc for retaining fibres thereon; radially extending slits made through said discs for the passage of a stream of air created by said blades radially arranged on the surface of said flat disc, facing said body of said twisting member;

an opening for the passage of the core thread made in said disc eccentrically with respect to said axis of rotation of said twisting member;

a holder for a bobbin with the supply of said core thread; a unit for winding the reinforced thread;

said guide of said core thread overlying the plane of said flat disc.

* * * * *